US008075712B2

(12) United States Patent
Farmer

(10) Patent No.: US 8,075,712 B2
(45) Date of Patent: Dec. 13, 2011

(54) AMORPHOUS METAL FORMULATIONS AND STRUCTURED COATINGS FOR CORROSION AND WEAR RESISTANCE

(75) Inventor: Joseph C. Farmer, Tracy, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 821 days.

(21) Appl. No.: 11/598,940

(22) Filed: Nov. 13, 2006

(65) Prior Publication Data

US 2007/0107810 A1 May 17, 2007

Related U.S. Application Data

(60) Provisional application No. 60/736,958, filed on Nov. 14, 2005.

(51) Int. Cl.
*C22C 45/00* (2006.01)

(52) U.S. Cl. ..... 148/403

(58) Field of Classification Search ..... None
See application file for complete search history.

(56) References Cited

U.S. PATENT DOCUMENTS

| | | | | |
|---|---|---|---|---|
| 4,522,844 | A | 6/1985 | Khanna et al. | |
| 4,613,371 | A * | 9/1986 | Cheney et al. | 75/255 |
| 4,863,810 | A | 9/1989 | Bhattacharya et al. | |
| 4,939,041 | A | 7/1990 | Kabacoff et al. | |
| 4,965,139 | A | 10/1990 | Kabacoff et al. | |
| 5,211,776 | A | 5/1993 | Weiman | |
| 5,376,191 | A | 12/1994 | Roman et al. | |
| 6,125,912 | A | 10/2000 | Branagan et al. | |
| 6,767,419 | B1 * | 7/2004 | Branagan | 148/522 |
| 2001/0035129 | A1 * | 11/2001 | Chandra et al. | 118/722 |
| 2003/0051781 | A1 | 3/2003 | Branagan | |
| 2005/0013723 | A1 | 1/2005 | Branagan | |
| 2005/0123686 | A1 | 6/2005 | Myrick | |

FOREIGN PATENT DOCUMENTS

| | | | |
|---|---|---|---|
| EP | 0 036 892 | B1 | 6/1986 |
| EP | 0 026 237 | B1 | 7/1986 |
| EP | 0 260 706 | B1 | 8/1992 |
| EP | 0 576 366 | B1 | 3/1996 |
| EP | 1 378 578 | A1 | 1/2004 |
| WO | WO 2004/079749 | A2 | 9/2004 |
| WO | WO 2004/106565 | A2 | 12/2004 |

* cited by examiner

*Primary Examiner* — Jessica L Ward
*Assistant Examiner* — Yoshitoshi Takeuchi
(74) *Attorney, Agent, or Firm* — Eddie E. Scott; James S. Tak

(57) ABSTRACT

A system for coating a surface comprising providing a source of amorphous metal that contains more than 11 elements and applying the amorphous metal that contains more than 11 elements to the surface by a spray. Also a coating comprising a composite material made of amorphous metal that contains more than 11 elements. An apparatus for producing a corrosion-resistant amorphous-metal coating on a structure comprises a deposition chamber, a deposition source in the deposition chamber that produces a deposition spray, the deposition source containing a composite material made of amorphous metal that contains more than 11 elements, and a system that directs the deposition spray onto the structure.

9 Claims, 2 Drawing Sheets

AMORPHOUS METAL FORMULATIONS AND STRUCTURED COATINGS FOR CORROSION AND WEAR RESISTANCE

CROSS-REFERENCE TO RELATED APPLICATION

This application claims the benefit of U.S. Provisional Patent Application No. 60/736,958 filed Nov. 14, 2005 and titled "New Composites Consisting of Amorphous Metals and Ceramic Nano-Particles Serving as High-Performance Corrosion-Resistant Materials with High Critical Cooling Rates, Damage Tolerance, High Hardness and Exceptional Wear Resistance." U.S. Provisional Patent Application No. 60/736,958 filed Nov. 14, 2005 and titled "New Composites Consisting of Amorphous Metals and Ceramic Nano-Particles Serving as High-Performance Corrosion-Resistant Materials with High Critical Cooling Rates, Damage Tolerance, High Hardness and Exceptional Wear Resistance" is incorporated herein by this reference.

The United States Government has rights in this invention pursuant to Contract No. W-7405-ENG-48 between the United States Department of Energy and the University of California for the operation of Lawrence Livermore National Laboratory.

BACKGROUND

1. Field of Endeavor

The present invention relates to amorphous metal and more particularly to amorphous metal formulations and structured coatings for corrosion and wear resistance.

2. State of Technology

International Patent Application No. WO 2004/106565 by The Nanosteel Company for "LAYERED METALLIC MATERIAL FORMED FROM IRON BASED GLASS ALLOYS," published Mar. 24, 2005, inventor Daniel James Branagan, provides the following state of technology information, "One of the layers therefore preferably has a hardness that is greater than the hardness of the underlying layer, to provide the layered metallic material herein. In that context, reference is made to U.S. Application Ser. Nos. 09,709,918 and 10,172,095, which are currently pending, and which disclose the preferred material for the high hardness material of the herein disclosed layered construction, and whose teachings are incorporated by reference. As disclosed therein, a hardened metallic material can be formed by forming a molten alloy and cooling said alloy to form a glass coating on a substrate. Such metallic glass coating has a hardness that is at least about 9.2 GPa, comprising an alloy preferably containing fewer than 11 elements."

SUMMARY

Features and advantages of the present invention will become apparent from the following description. Applicants are providing this description, which includes drawings and examples of specific embodiments, to give a broad representation of the invention. Various changes and modifications within the spirit and scope of the invention will become apparent to those skilled in the art from this description and by practice of the invention. The scope of the invention is not intended to be limited to the particular forms disclosed and the invention covers all modifications, equivalents, and alternatives falling within the spirit and scope of the invention as defined by the claims.

The present invention provides a system for coating a surface comprising providing a source of amorphous metal that contains more than 11 elements and applying the amorphous metal that contains more than 11 elements to the surface by a spray. In one embodiment the amorphous metal that contains more than 11 elements comprises iron or nickel based amorphous metal with a minimum of twelve alloying elements and up to twenty alloying elements. In another embodiment the amorphous metal that contains more than 11 elements comprises iron or nickel based amorphous metal with up to twenty alloying elements selected from the group comprising Fe, Co, Ni, Mn, B, C, Cr, Mo, W, Si, Ta, Nb, Al, Zr, Ti, La, Gd, Y, O and N.

The present invention also provides coating comprising a composite material made of amorphous metal that contains more than 11 elements. In one embodiment the amorphous metal that contains more than 11 elements comprises iron or nickel based amorphous metal with a minimum of twelve alloying elements and up to twenty alloying elements. In another embodiment the amorphous metal that contains more than 11 elements comprises iron or nickel based amorphous metal with up to twenty alloying elements selected from the group comprising Fe, Co, Ni, Mn, B, C, Cr, Mo, W, Si, Ta, Nb, Al, Zr, Ti, La, Gd, Y, O and N.

The present invention also provides an apparatus for producing a corrosion-resistant amorphous-metal coating on a structure comprising a deposition chamber, a deposition source in the deposition chamber that produces a deposition spray, the deposition source containing a composite material made of amorphous metal that contains more than 11 elements, and a system that directs the deposition spray onto the structure. In one embodiment the amorphous metal that contains more than 11 elements comprises iron or nickel based amorphous metal with a minimum of twelve alloying elements and up to twenty alloying elements. In another embodiment the amorphous metal that contains more than 11 elements comprises iron or nickel based amorphous metal with up to twenty alloying elements selected from the group comprising Fe, Co, Ni, Mn, B, C, Cr, Mo, W, Si, Ta, Nb, Al, Zr, Ti, La, Gd, Y, O and N.

The invention is susceptible to modifications and alternative forms. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and constitute a part of the specification, illustrate specific embodiments of the invention and, together with the general description of the invention given above, and the detailed description of the specific embodiments, serve to explain the principles of the invention.

DETAILED DESCRIPTION OF THE INVENTION

Figure 1:
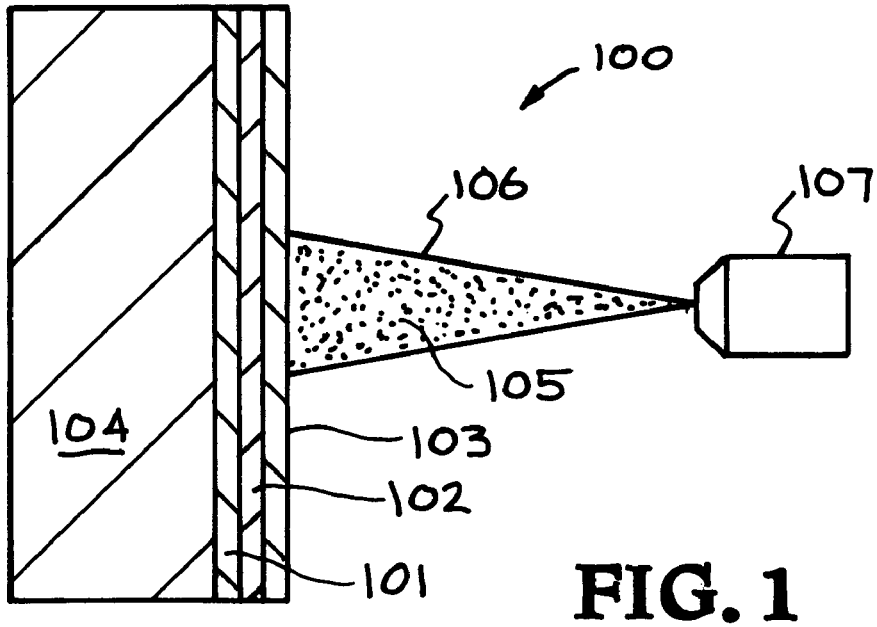
FIG. 1 illustrates one embodiment of a system of the present invention.

Referring to the drawings, to the following detailed description, and to incorporated materials, detailed information about the invention is provided including the description of specific embodiments. The detailed description serves to explain the principles of the invention. The invention is susceptible to modifications and alternative forms. The invention is not limited to the particular forms disclosed. The invention covers all modifications, equivalents, and alternatives falling within the spirit and scope of the invention as defined by the claims.

Corrosion costs the nation billions of dollars every year, with an immense quantity of material in various structures undergoing corrosion. For example, in addition to fluid and seawater piping, ballast tanks, and propulsions systems, approximately 345 million square feet of structure aboard naval ships and crafts require costly corrosion control measures. The use of advanced corrosion-resistant materials to prevent the continuous degradation of this massive surface area would be extremely beneficial. The corrosion-resistant, amorphous-metal coatings under development may prove of importance for applications on ships. The possible advantages of amorphous metals have been recognized for some time.

The present invention provides advanced formulations of corrosion-resistant amorphous-metals. New elemental compositions are being developed and tested for corrosion and wear resistant amorphous metals, along with composites that incorporate these and other similar amorphous metals, and layered and graded coatings with amorphous metals and ceramics. These and other amorphous metal coatings can be produced as graded coatings, where the coating gradually transitions from the metallic substrate material that is being protected by the coating, to a pure amorphous metal coating, or to a amorphous metal multilayer coating, and eventually to a ceramic outer layer, which provides extreme corrosion and wear resistance. The grading can be accomplished by gradually shifting from and amorphous metal powder to a ceramic powder during cold or thermal spray operations. Some of the softer ingredients such as aluminum can be used as a relatively soft binder during cold spray operations. In addition to including the boron, which serves as a neutron absorber, in elemental form within the alloy, it can also be introduced as a carbide or other intermetallic particle such as B4C, thereby enabling even high neutron absorption to be achieved with a given thickness of coating.

The present invention provides advanced formulations of corrosion-resistant amorphous-metals comprising a composite material made of amorphous metal that contains more than eleven elements. In one embodiment the present invention comprises a coating wherein the amorphous metal that contains more than eleven elements comprises iron or nickel based amorphous metal with a minimum of twelve alloying elements and up to twenty alloying elements. In another embodiment comprises a coating wherein the amorphous metal that contains more than 11 elements comprises iron or nickel based amorphous metal with up to twenty alloying elements selected from the group comprising Fe, Co, Ni, Mn, B, C, Cr, Mo, W, Si, Ta, Nb, Al, Zr, Ti, La, Gd, Y, O and N.

A layered metallic material formed from iron based glass alloys having a hardened metallic material that can be formed by forming a molten alloy and cooling said alloy to form a glass coating on a substrate, wherein such metallic glass coating has a hardness that is at least about 9.2 GPa, comprising an alloy preferably containing fewer than 11 elements is disclosed in International Patent Application No. WO 2004/106565 by The Nanosteel Company published Mar. 24, 2005. International Patent Application No. WO 2004/106565 by The Nanosteel Company published Mar. 24, 2005 for layered metallic material formed from iron based glass alloys is incorporated herein by this reference.

Specific attributes of the advanced formulations of corrosion-resistant amorphous-metals of the present invention include:

(1) Iron or nickel based amorphous metal with a minimum of ten alloying elements, and up to twenty alloying elements. Ingredients include: Fe, Co, Ni, Mn, B, C, Cr, Mo, W, Si, Ta, Nb, Al, Zr, Ti, La, Gd, Y, O, and N.

(2) Fe, Co, Ni and Mn are used as base materials for the alloy.

(3) B, P and C are added to promote glass forming.

(4) B and P also form buffers in the near surface region during corrosive dissolution, thereby preventing hydrolysis-induced acidification that accompanies pitting and crevice corrosion.

(5) Cr, Mo, W and Si are added to enhance corrosion resistance.

(6) Ta and Nb are added to further enhance corrosion resistance, especially in acidic environments.

(7) Al, Ti and Zr add strength, while maintaining relatively low weight.

(8) Y and other rare earths are added to lower the critical cooling rate.

(9) B and Gd are added in solid solution, or as intermetallic phases, to absorb neutrons in applications where criticality control is important.

(10) Oxygen and nitrogen are added intentionally, and in a controlled manner, to enable the formation of oxide and nitride particles in situ, which interrupt the shear banding associated with fracture of amorphous metals, and thereby enhance damage tolerance.

The present invention has many uses. For example, the present invention can be used for metal-ceramic armor; projectiles; gun barrels, tank loader trays, rail guns, non-magnetic hulls, hatches, seals, propellers, rudders, planes, ships, submarines oil and water drilling equipment; earth moving equipment; tunnel-boring machinery; pump impellers & shafts; containers for shipment, storage and disposal of spent nuclear fuel; pressurized water reactors; boiling water reactors; Gen IV reactors with liquid metal (PbBi) coolant, and other uses. Such materials could also be used to coat the entire outer surface of containers for the transportation and long-term storage of high-level radioactive waste (HLW) spent nuclear fuel (SNF), or to protect welds and heat affected zones, thereby preventing exposure to environments that might cause stress corrosion cracking. In the future, it may be possible to substitute such high-performance iron-based materials for more-expensive nickel-based alloys, thereby enabling cost savings in various industrial applications.

Referring now to the drawings and in particular to FIG. 1, one embodiment of a system of the present invention is illustrated. This embodiment is designated generally by the reference numeral 100. The embodiment 100 provides a corrosion resistant amorphous metal coating 108. The corrosion resistant amorphous metal coating 108 is produced by spray processing to form a composite coating made of amorphous metal. As illustrated in FIG. 1, a corrosion-resistant amorphous-metal 105 is sprayed to form the coating 108 containing a multiplicity of layers 101, 102, 103, etc.

As illustrated in FIG. 1, the alternating layers 101, 102, 103, etc. are applied to a structure 104. An individual 107 is shown applying the coating 108 by the spray 103. A spray device 606 produces the spray 105. Different spray processing systems can be used to form the coating 108, for example the spray processing can be flame spray processing, plasma spray processing, high-velocity oxy-fuel (HVOF) spray processing, high-velocity air-spray (HVAF) processing, detonation gun processing, or other spray processes. The spray processing can be thermal spray processing or cold spray processing.

The present invention provides the coating 108 made of advanced formulations of corrosion-resistant amorphous-metals. The coating 108 comprises a composite material made of amorphous metal that contains more than eleven elements. The coating 108 is made of amorphous metal that contains more than eleven elements. In one embodiment, the coating 108 comprises iron or nickel based amorphous metal with a minimum of twelve alloying elements and up to twenty alloying elements. Another embodiment comprises a coating 108 wherein the amorphous metal that contains more than eleven elements comprises iron or nickel based amorphous metal with up to twenty alloying elements selected from the group comprising Fe, Co, Ni, Mn, B, C, Cr, Mo, W, Si, Ta, Nb, Al, Zr, Ti, La, Gd, Y, O and N.

Specific attributes of the advanced formulations of corrosion-resistant amorphous-metals of coating 108 of the present invention include:

(1) Iron or nickel based amorphous metal with a minimum of ten alloying elements, and up to twenty alloying elements. Ingredients include: Fe, Co, Ni, Mn, B, C, Cr, Mo, W, Si, Ta, Nb, Al, Zr, Ti, La, Gd, Y, O, and N.

(2) Fe, Co, Ni and Mn are used as base materials for the alloy.

(3) B, P and C are added to promote glass forming.

(4) B and P also form buffers in the near surface region during corrosive dissolution, thereby preventing hydrolysis-induced acidification that accompanies pitting and crevice corrosion.

(5) Cr, Mo, W and Si are added to enhance corrosion resistance.

(6) Ta and Nb are added to further enhance corrosion resistance, especially in acidic environments.

(7) Al, Ti and Zr add strength, while maintaining relatively low weight.

(8) Y and other rare earths are added to lower the critical cooling rate.

(9) B and Gd are added in solid solution, or as intermetallic phases, to absorb neutrons in applications where criticality control is important.

(10) Oxygen and nitrogen are added intentionally, and in a controlled manner, to enable the formation of oxide and nitride particles in situ, which interrupt the shear banding associated with fracture of amorphous metals, and thereby enhance damage tolerance.

The coating 108 of the present invention provides advanced formulations of corrosion-resistant amorphous-metals. New elemental compositions are being developed and tested for corrosion and wear resistant amorphous metals, along with composites that incorporate these and other similar amorphous metals, and layered and graded coatings with amorphous metals and ceramics. These and other amorphous metal coatings can be produced as graded coatings, where the coating gradually transitions from the metallic substrate material that is being protected by the coating, to a pure amorphous metal coating, or to a amorphous metal multilayer coating, and eventually to an outer layer, which provides extreme corrosion and wear resistance. The grading can be accomplished by gradually shifting from one amorphous metal powder to another amorphous powder during cold or thermal spray operations. Some of the softer ingredients such as aluminum can be used as a relatively soft binder during cold spray operations. In addition to including the boron, which serves as a neutron absorber, in elemental form within the alloy, it can also be introduced as a carbide or other intermetallic particle such as B4C, thereby enabling even high neutron absorption to be achieved with a given thickness of coating.

Figure 2:
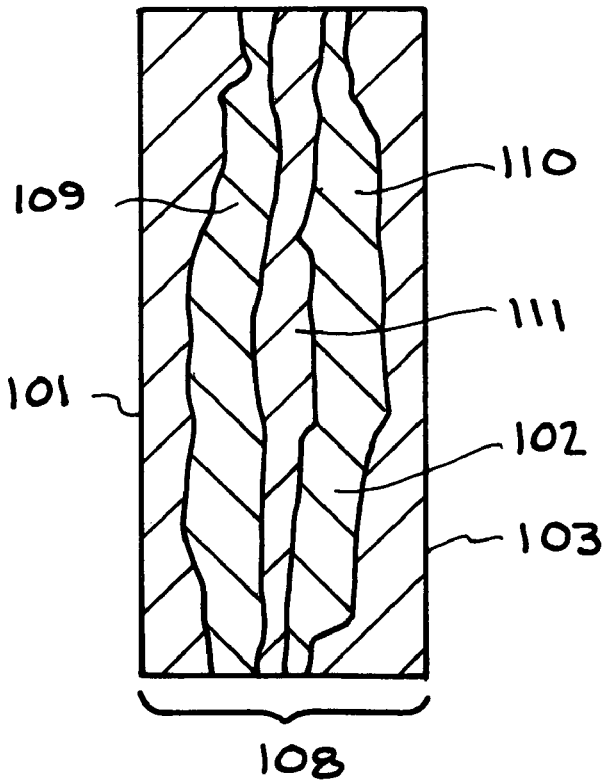
FIG. 2 shows an enlarged view of a portion of the coating shown in FIG. 1.

Referring now to FIG. 2, an enlarged view of a portion of the coating 108 is shown. The coating 108 is a graded coating that contains the multiplicity of layers 101, 102, and 103. A transition section 109 between the layer 101 and layer 102 is shown. A transition section 110 between the layer 102 and layer 103 is shown. The central section 111 of layer 102 does not form part of the transition section 109 or the transition section 110. The coating 108 gradually transitions from the metallic substrate material that is being protected by the coating 108, to an amorphous metal multilayer coating, and eventually to an outer layer, which provides extreme corrosion and wear resistance. In one embodiment the layer 102 comprises a composite material made of amorphous metal that contains more than eleven elements. The layer 102 is made of amorphous metal that contains more than eleven elements. The layer 102 comprises iron or nickel based amorphous metal with a minimum of twelve alloying elements and up to twenty alloying elements.

By intentionally controlling the powder morphology so that it is non-spherical, and irregular in shape, coatings of know porosity can be produced, thereby enabling the incorporation of self-lubricating agents such as fluorinated hydrocarbon polymers (Teflon™ etc.). The pores serve as host sites for the lubricating polymer.

The porosity can also host other polymeric materials that can provide sensing capability to the coating. For example, polymers can be incorporated that change color upon acidification that occurs during the onset of pitting and crevice corrosion. Thus, the coatings are both protective, and self-diagnosing. The porosity can also host biocides that can be time-released in such a manner to prevent the onset of microbial induced corrosion (MIC).

These materials can be rendered as amorphous metals by electrochemical deposition, sputter deposition, evaporation, melt spinning, arc melting and drop casting, gas atomization, cryogenic co-milling of elements, thermal spray deposition, cold spray deposition, induction-heated cold-spray jets, and other such methodologies.

The coating 108 of the present invention has many uses. For example, the coating 108 can be used for metal-ceramic armor; projectiles; gun barrels, tank loader trays, rail guns, non-magnetic hulls, hatches, seals, propellers, rudders, planes, ships, submarines oil and water drilling equipment; earth moving equipment; tunnel-boring machinery; pump impellers & shafts; containers for shipment, storage and disposal of spent nuclear fuel; pressurized water reactors; boiling water reactors; Gen IV reactors with liquid metal (PbBi) coolant, and other uses. Such materials could also be used to coat the entire outer surface of containers for the transportation and long-term storage of high-level radioactive waste (HLW) spent nuclear fuel (SNF), or to protect welds and heat affected zones, thereby preventing exposure to environments that might cause stress corrosion cracking. Another use of the coating 108 is to substitute it for more-expensive nickel-based alloys, thereby enabling cost savings in various industrial applications.

Figure 3:
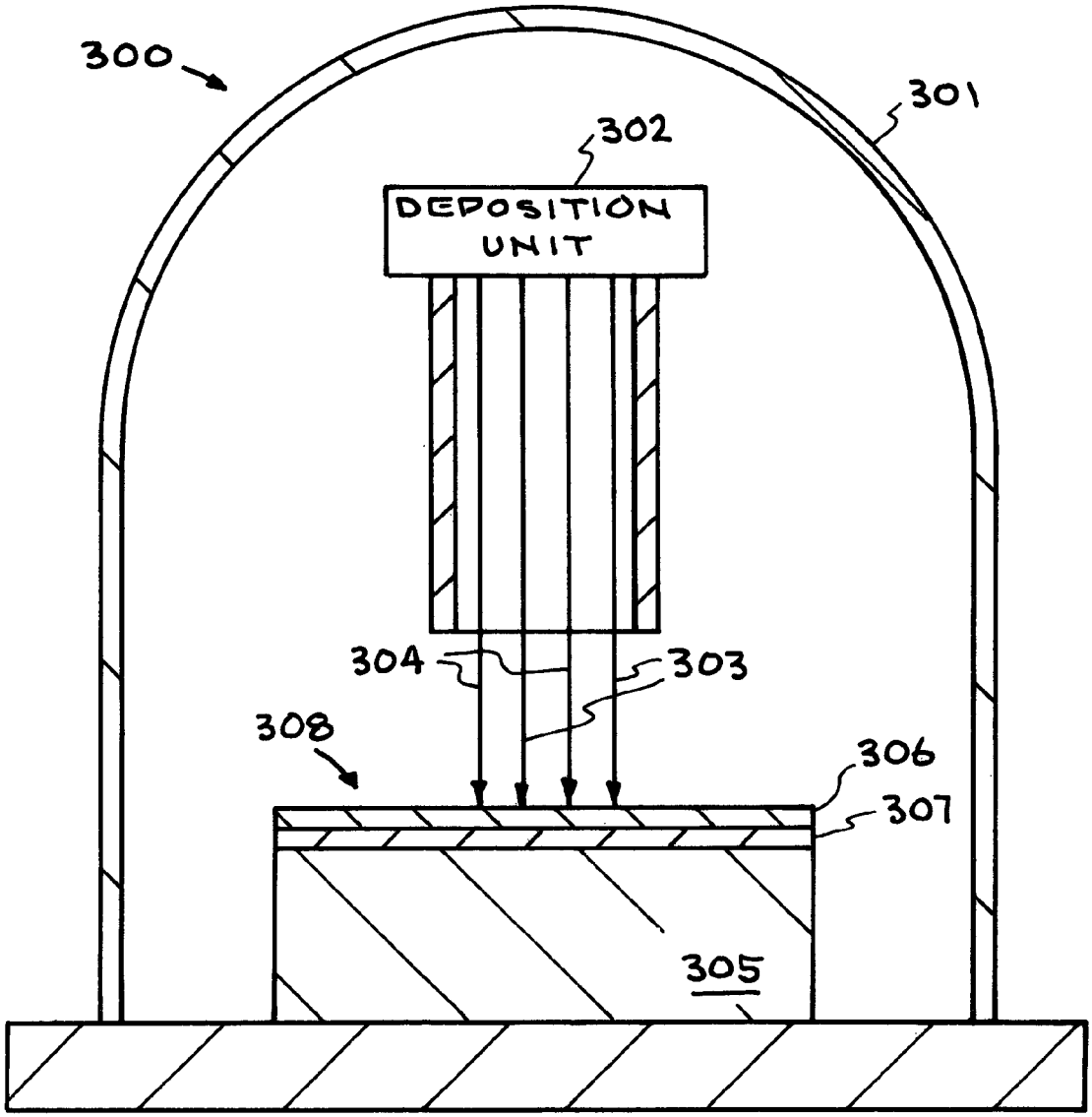
FIG. 3 illustrates another embodiment of a system of the present invention.

Referring now to FIG. 3, another embodiment of a system of the present invention is illustrated. This embodiment is designated generally by the reference numeral 300. A deposition chamber 301 contains a deposition system including deposition units 302. The deposition units 302 produce deposition spray 303 and deposition spray 304. The deposition sprays 303 and 304 are directed onto the surface of the structure 305 that is to be coated. For example the structure 305 can be an element of a plane, a ship, a submarine, oil and water drilling equipment, earth moving equipment, tunnel-boring machinery, or other equipment. The element coated by the system 300 can be used for metal armor, projectiles, gun barrels, tank loader trays, rail guns, non-magnetic hulls, hatches, seals, propellers, rudders, pump impellers and shafts, containers for spent nuclear fuel, pressurized water reactors, boiling water reactors, Gen IV reactors with liquid metal (PbBi) coolant, and other uses. The element coated by the system 300 can be used for containers for the transportation and long-term storage of high-level radioactive waste (HLW) spent nuclear fuel (SNF), or to protect welds and heat affected zones, thereby preventing exposure to environments that might cause stress corrosion cracking. Another use of the coating 308 is to substitute it for more-expensive nickel-based alloys, thereby enabling cost savings in various industrial applications.

The deposition units 302 that produce the deposition spray 303 and deposition spray 304 are sources of amorphous metal that contains more than eleven elements. For example, the source of the deposition spray 303 can a source of amorphous metal that comprises iron or nickel based amorphous metal with a minimum of twelve alloying elements and up to twenty alloying elements. Another example, the source of the deposition spray 304 can a source of amorphous metal that contains more than eleven elements comprising iron or nickel based amorphous metal with up to twenty alloying elements selected from the group comprising Fe, Co, Ni, Mn, B, C, Cr, Mo, W, Si, Ta, Nb, Al, Zr, Ti, La, Gd, Y, O and N. Some specific attributes of the source of deposition spray 303 and deposition spray 304: (1) Iron or nickel based amorphous metal with a minimum of ten alloying elements, and up to twenty alloying elements. Ingredients include: Fe, Co, Ni, Mn, B, C, Cr, Mo, W, Si, Ta, Nb, Al, Zr, Ti, La, Gd, Y, O, and N; (2) Fe, Co, Ni and Mn are used as base materials for the alloy; (3) B, P and C are added to promote glass forming; (4) B and P also form buffers in the near surface region during corrosive dissolution, thereby preventing hydrolysis-induced acidification that accompanies pitting and crevice corrosion; (5) Cr, Mo, W and Si are added to enhance corrosion resistance; (6) Ta and Nb are added to further enhance corrosion resistance, especially in acidic environments; (7) Al, Ti and Zr add strength, while maintaining relatively low weight; (8) Y and other rare earths are added to lower the critical cooling rate; (9) B and Gd are added in solid solution, or as intermetallic phases, to absorb neutrons in applications where criticality control is important; and/or (10) Oxygen and nitrogen are added intentionally, and in a controlled manner, to enable the formation of oxide and nitride particles in situ, which interrupt the shear banding associated with fracture of amorphous metals, and thereby enhance damage tolerance.

The embodiment 300 provides a corrosion resistant amorphous metal coating 308. The corrosion resistant amorphous metal coating 308 is produced by deposition processing to form a composite coating made of amorphous metal. As illustrated in FIG. 3, a corrosion-resistant amorphous-metal forms the coating 308 on a structure 305 by deposition. Different deposition processing systems can be used to form the coating 308. For example electrochemical deposition, or sputter deposition can be used to form the coating 308.

The coating 308 of the present invention provides advanced formulations of corrosion-resistant amorphous-metals. New elemental compositions are being developed and tested for corrosion and wear resistant amorphous metals, along with composites that incorporate these and other similar amorphous metals, and layered and graded coatings with amorphous metals and ceramics. These and other amorphous metal coatings can be produced as graded coatings, where the coating gradually transitions from the metallic substrate material that is being protected by the coating, to a pure amorphous metal coating, or to a amorphous metal multilayer coating, and eventually to an outer layer, which provides extreme corrosion and wear resistance. The grading can be accomplished by gradually shifting from one amorphous metal powder to another amorphous powder during cold or thermal spray operations. Some of the softer ingredients such as aluminum can be used as a relatively soft binder during cold spray operations. In addition to including the boron, which serves as a neutron absorber, in elemental form within the alloy, it can also be introduced as a carbide or other intermetallic particle such as B4C, thereby enabling even high neutron absorption to be achieved with a given thickness of coating.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus for producing a corrosion-resistant amorphous-metal coating on a structure, comprising:

a deposition chamber, a deposition source in said deposition chamber, said deposition source including a first deposition source that produces a first deposition spray and a second deposition source that produces a second deposition spray, said first deposition source containing a composite material made of amorphous metal that contains more than 11 elements, said second deposition source containing a composite material made of amorphous metal that contains more than 11 elements, and a system that directs said first deposition spray onto the structure and directs said second deposition spray onto the structure.

2. The apparatus for producing a corrosion-resistant amorphous-metal coating on a structure of claim 1 wherein said first deposition source containing a composite material made of amorphous metal that contains more than 11 elements comprises iron or nickel based amorphous metal with a minimum of twelve alloying elements and up to twenty alloying elements.

3. The apparatus for producing a corrosion-resistant amorphous-metal coating on a structure of claim 1 wherein said first deposition source containing a composite material made of amorphous metal that contains more than 11 elements comprises iron or nickel based amorphous metal with up to twenty alloying elements selected from the group comprising Fe, Co, Ni, Mn, B, C, Cr, Mo, W, Si, Ta, Nb, Al, Zr, Ti, La, Gd, Y, O and N.

4. The apparatus for producing a corrosion-resistant amorphous-metal coating on a structure of claim 1 wherein said second deposition source containing a composite material made of amorphous metal includes an alloy having a base material and wherein Fe, Co, Ni and Mn are used as said base material for said alloy.

5. The apparatus for producing a corrosion-resistant amorphous-metal coating on a structure of claim 1 wherein said second deposition source containing a composite material made of amorphous metal that contains more than 11 elements includes B, P and C added to promote glass forming.

6. The apparatus for producing a corrosion-resistant amorphous-metal coating on a structure of claim 1 wherein said second deposition source containing a composite material made of amorphous metal that contains more than 11 elements includes Cr, Mo, W and Si to enhance corrosion resistance.

7. The apparatus for producing a corrosion-resistant amorphous-metal coating on a structure of claim 1 wherein said second deposition source containing a composite material made of amorphous metal that contains more than 11 elements includes Ta and Nb to further enhance corrosion resistance in acidic environments.

8. The apparatus for producing a corrosion-resistant amorphous-metal coating on a structure of claim 1 wherein said second deposition source containing a composite material made of amorphous metal that contains more than 11 elements includes Al, Ti and Zr for strength while maintaining relatively low weight.

9. The apparatus for producing a corrosion-resistant amorphous-metal coating on a structure of claim 1 wherein said second deposition source containing a composite material made of amorphous metal that contains more than 11 elements includes B and Gd to absorb neutrons.

* * * * *